United States Patent [19]

Morris et al.

[11] 4,433,445

[45] Feb. 28, 1984

[54] DUAL FLUSH TOILET MECHANISM

[76] Inventors: George R. Morris, 3760 N. Vista, NW.; John A. Frient, 3785 N. Vista, NW., both of Uniontown, Ohio 44685

[21] Appl. No.: 307,373

[22] Filed: Oct. 1, 1981

[51] Int. Cl.[3] ..... E03D 3/12

[52] U.S. Cl. ..... 4/325; 4/410; 4/413; 4/415

[58] Field of Search ..... 4/324, 325, 405, 410, 4/412–415

[56] References Cited

U.S. PATENT DOCUMENTS

| | | | |
|---|---|---|---|
| 3,331,084 | 7/1967 | Wustner | 4/325 |
| 4,017,912 | 4/1977 | Young | 4/324 |
| 4,038,707 | 8/1977 | Cass | 4/324 |
| 4,067,074 | 1/1978 | Harrison | 4/324 |
| 4,141,092 | 2/1979 | Jones | 4/413 X |

FOREIGN PATENT DOCUMENTS

| | | | |
|---|---|---|---|
| 2752465 | 5/1979 | Fed. Rep. of Germany | 4/325 |

*Primary Examiner*—Charles E. Phillips

*Attorney, Agent, or Firm*—Oldham, Oldham, Hudak, Weber & Sand Co.

[57] ABSTRACT

A half-flush mechanism for a commode. The half-flush mechansim allows user control of the amount of water used in flushing the commode. Activation of the mechanism entails pushing of a button located in an otherwise conventional flush handle. The mechanism is always in the full flush mode and returns to the full flush mode until again activated by the pushing of the half-flush button. The half-flush mechanism is adaptable to a variety of commode designs and may be adjusted by the user to release varying amounts of water during the half-flush mode.

11 Claims, 6 Drawing Figures

DUAL FLUSH TOILET MECHANISM

TECHNICAL FIELD

This invention lies in the art of flushing mechanisms for water closets or commodes. In particular, the invention relates to a device which, at the discretion of the user, decreases the amount of water used in flushing, such that a savings of water is effected thereby.

BACKGROUND ART

For many years it has been recognized that residential toilets, in performing their function, often require only a fraction of the water actually consumed per flush. For example, the elimination of liquid waste may require only half of the 5–6 gallon capacity of the tank. Nevertheless, by design, the standard toilet flush does not have the capacity to reduce water consumption accordingly. Invariably the tank is drained with each and every flush, thereby resulting in inefficient and wasteful use of water.

Teachings presently in the art have attempted to solve this problem by modification or replacement of the existing flush mechanism which thereby affords a degree of user control over the amount of water used per flush. Examples of prior art are U.S. Pat. Nos. 2,001,390; 3,758,893; 3,906,554; 3,999,223; 4,038,707; 4,067,074; 4,117,556; 4,141,092; and 4,225,987.

All of the above references, however, lack one or more necessary elements for successful wide utilization in the industry. That is, these prior art references may be prohibitively expensive, too complicated, require the complete replacement of the existing flush mechanism or may be used with only certain models of commodes.

There is perceived thereby a need to provide a mechanism which will reduce the amount of water wasted in the flushing operation and which does not have the above-mentioned disadvantages.

DISCLOSURE OF INVENTION

In light of the foregoing, it is an object of the instant invention to provide a flushing device which will reduce the amount of water wasted in flushing a toilet.

A further object of the invention is to provide a device which can be installed by one possessing only ordinary mechanical ability.

Another object of the instant invention is to provide a flushing device which does not require complete replacement of the existing flush mechanism.

Still another object of the instant invention is to provide a flushing device which may be adapted for installation in a variety of flushing mechanism designs.

A still further object of the instant invention is to provide a flushing device which is inexpensive, simple in design, and constructed of readily replaceable parts.

These objects and others which will be discussed further in the insuing description, may be achieved by: a half-flush mechanism for a commode, comprising: an angled half-flush rod; a float attached to a first leg of said angled rod which is located within the commode tank; a flush handle within which is slidably mounted a second leg of said angled rod; a push button located at the end of said second leg; a compression spring applying a force to said angled rod at its apex; a mechanism housing surrounding said spring and said second leg of said angled rod; a stationary mount which prevents operation of said half-flush mechanism when a full flush is desired; a housing end piece which fits over said mechanism housing; a flush lever attached to said housing end piece; and means for securing said mechanism in the commode tank wall.

BRIEF DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 1:
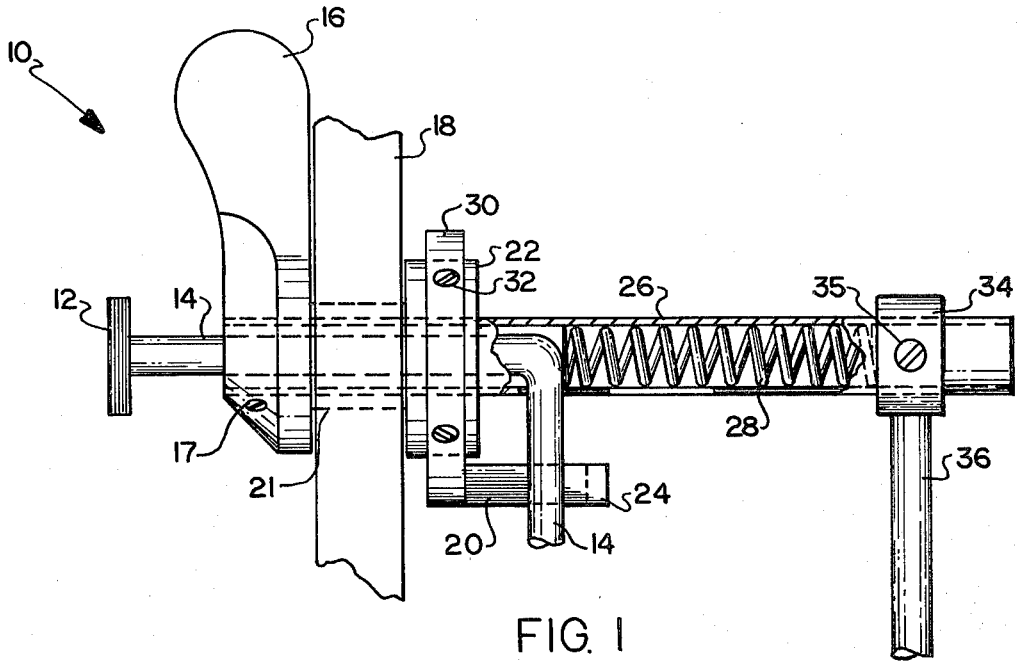
FIG. 1 is a top view of the dual flush mechanism.
Figure 2:
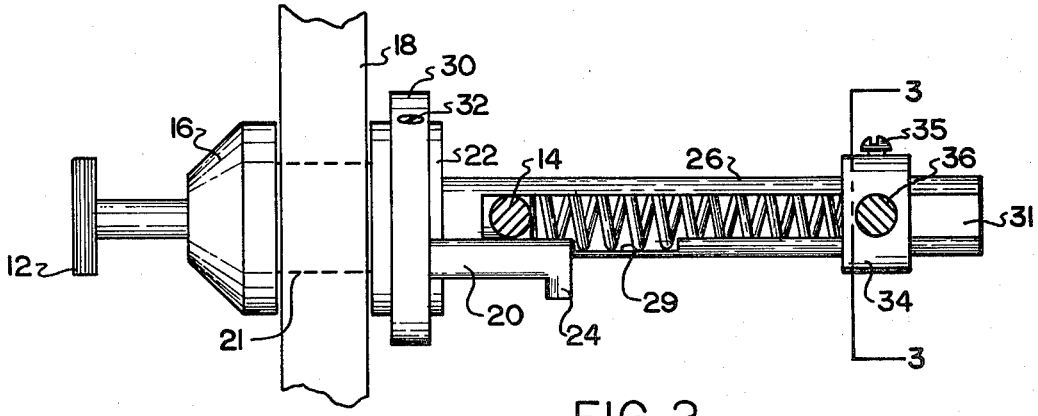
FIG. 2 is a front view of the dual flush mechanism.

With reference to FIGS. 1 and 2, it is noted that a dual flush mechanism drawn according to the teachings of the invention is designated generally by the number 10. The dual flush mechanism 10 is installed in the wall of the commode tank 18 by means of the tank wall insert 21 and the securement nut 22. The outer fixtures of the dual flush mechanism, as seen to the left of the tank wall 18 in FIGS. 1 and 2, consist of the flushing handle 16, the push button for half-flush 12, and the angled half-flush rod 14. The flushing handle 16 is secured to the flush mechanism housing 26 by means of set screw 17. It is noted that the flush mechanism housing 26 extends completely through the flush handle 16 so as to be flush with the outer surface of the handle 16, although this need not be the case. Further, securement of the housing 26 to the flush handle 16 may be brought about by means other than by set screws.

The angled half-flush rod 14 is slidably mounted within the flush mechanism housing 26 and the push button 12 may be secured to the tip of the half-flush rod 14 in any manner well known in the art. However, it is preferred that the push button 12 be secured in a removable fashion so as to facilitate assembly of the flushing mechanism 10.

To the right of the tank wall 18 as viewed in FIGS. 1 and 2, it is noted that the half-flush rod 14 is bent at an angle at the point where it contacts spring 28. The angle may be 90° as shown, or may be of some angle other than 90° in order to accommodate the shape or design of the toilet. In any event, the leg of the angled half-flush rod 14 opposite that at which the push button 12 is secured, extends along a path roughly parallel to the tank wall 18. Along this path it can be seen that the rod 14 rests upon a stationary mount 20 and continues along on its parallel extension.

The stationary mount 20 is attached to a securement nut 22 by means of a collar 30 which extends around said securement nut and is secured in place by means of set screws 32. As can best be seen in FIG. 2, the tip 24 of the stationary mount 20 extends downward in a vertical fashion to a considerable length. The purpose of this downward extension will be described shortly.

Figure 3:
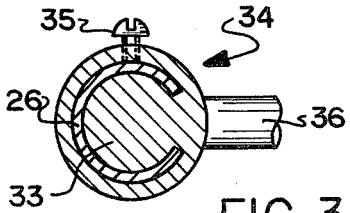
FIG. 3 is a cross-sectional view of the end piece which fits onto the housing of the dual flush mechanism.

The mechanism housing 26 is of hollow, cylindrical construction. Further, the portion of the mechanism housing 26 which extends into the tank from the securement nut 22 is seen to have a portion of its perimeter removed slitwise. This slit 31 is illustrated in FIG. 3, which shows that the mechanism housing 26 has a C-shaped cross-sectional appearance. The slit 31 in the flush housing mechanism 26 is made wide enough to allow that leg of the half-flush rod 14 which runs roughly parallel to the tank wall 18 to extend out of the body of the housing 26. It is noted that the slit 31 extends from the position of the half-flush rod 14 to the tip of the mechanism housing 26 shown at the right end of FIGS. 1 and 2.

The reason for the extension of the slit 31 to the end of the housing is to facilitate assembly of the mechanism 10 and to fit a housing end piece 34 over the end of the mechanism housing 26. However, as will be made more clear shortly, in actual operation the rod 14 extends through the slit only at the point just past the end of the stationary mount 20. At this point, the slit 31 is extended downward to form cut out 29.

The cross-sectional shape of the mechanism end piece 34 is seen in FIG. 3, wherein the end piece 34 is secured to the mechanism housing 26 by means of a set screw 35. An extension 33 of the end piece 34 fits through the slit 31 in the mechanism housing 26 and is flush with the internal wall of said mechanism housing. This internal extension 33 acts as a back stop to a spring 28. Further, the extension 33 serves as support to balance the stress on the housing 26 caused by use of set screw 35 securing end piece 34. Securing devices other than a set screw may however be employed. It is noted that the end piece 34 may be adjustably secured along mechanism housing 26 to accomodate the particular application.

In an alternative embodiment not illustrated, the mechanism end piece 34 may have an arcuate extension which covers slit 31 between cut-out 29 and the point of securement of end piece 34. This would prevent spring 28 from slipping out of housing 26 through slit 31. We have found that in many instances however, this added protection is unnecessary.

Extending outward from the end piece 34 is a flush lever 36. The lever 36 connects in well known fashion to flush stoppers conventional in the art and which hereinbelow will be described in detail.

Figure 4:
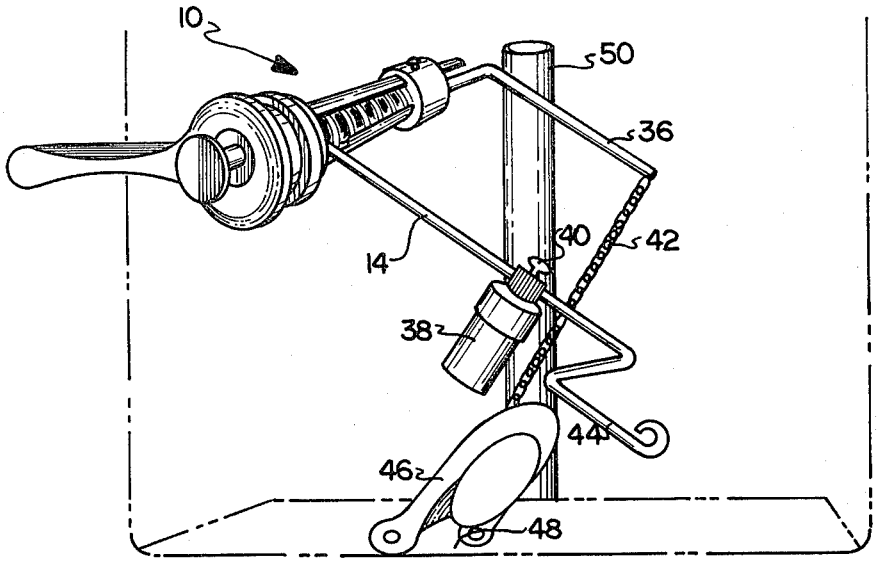
FIG. 4 shows one embodiment of the invention as installed.

With this in mind, reference is now made to FIG. 4, in which a typical embodiment of the invention is seen in detail. Here, it can be seen that a float 38 is secured to the half-flush rod 14 by means of an adjustable set screw 40. The set screw 40 allows securement of the float 38 along any portion of the length of the half-flush rod 14. Buoyancy of the float 38 is determined and adjusted by the amount of ballast contained therein. To the end of the flush lever 36 is secured a chain 42 of well known design, the other end of which is attached to the hinged flush stopper 46.

The half-flush mechanism 10 operates as follows:

Unless the mechanism 10 is activated, rod 14 remains stationary, being supported by the stationary mount 20. Rod 14 will remain in this position due to the biasing of the spring 28, which exerts force on the rod, keeping it from sliding off stationary mount. In this position, the half-flush mechanism 10 is inoperative and a full flush will ensue when flush handle 16 is depressed.

When the flushing handle 16 is pushed downward, the mechanism housing 26 simultaneously rotates by virtue of its securement to the flushing handle 16. As noted above, secured to the ends of the flush mechanism housing 26 is the housing end piece 34 and attached thereto is the flush lever 36. Thus, rotation of the mechanism housing 26 simultaneously forces the flush lever 36 upward which in turn lifts the hinged flush stopped 46 by means of the chain 42. In this manner, the flush operates in a normal mode as if the commode contained a conventional flushing mechanism. The tank is completely drained and then refilled.

By contrast, if the half-flush mechanism 10 is actuated during a flush, only a portion of the water contained in the tank is drained. To operate in the half-flush mode, the user initiates the flush cycle by depressing the flushing handle 16 in normal fashion, then, after the level of water in the tank has decreased somewhat, the user presses push button 12 with sufficient enthusiasm to overcome the force exerted by spring 28. This causes half-flush rod 14 to slide-off stationary mount 20, thus permitting float 38 to float on the surface of the water. Because the water level has been decreasing as the flush proceeds, rod 14 is now at an angle to the horizontal, as the float 38 follows the level of water down. To accomodate the angle at which rod 14 is now positioned, the slit 31 has been widened at the point immediately past the end of the stationary mount 20 to form cut-out 29.

Although spring 28 still exerts force on rod 14 after button 12 has been released, the rod cannot return to the stationary mount 20 due to the presence of stationary mount end piece 24 which acts as a backstop for the rod. After a predetermined amount of water has been drained from the tank, the angle of rod 14 becomes steep enough such that rod end section 44 is able to close hinged flush stopper 46 to preclude further draining of water. The half-flush has been thus completed, and the tank then refills as in a conventional flush.

The degree of water which is drained from the tank during the half-flush is determined in part by the amount of ballast present in the float 38, and the position of the float 38 along rod 14 which is varied by movement of the adjustment set screw 40. In other words, the angle at which the half-flush rod rests in the tank during the flush is determined by the amount of buoyancy and the location of float 38. In this manner, the half-flush mechanism 10 may be tailored to the individual commode and to the needs of the user.

When the tank has refilled with water, the float 38 allows the half-flush rod 14 to rise to an approximately horizontal position such that it again returns to the stationary mount 20 and is held there by the spring 28. The half-flush rod 14 will remain in this position until the button 12 is again pushed for operation of the half-flush mode.

Figure 5:
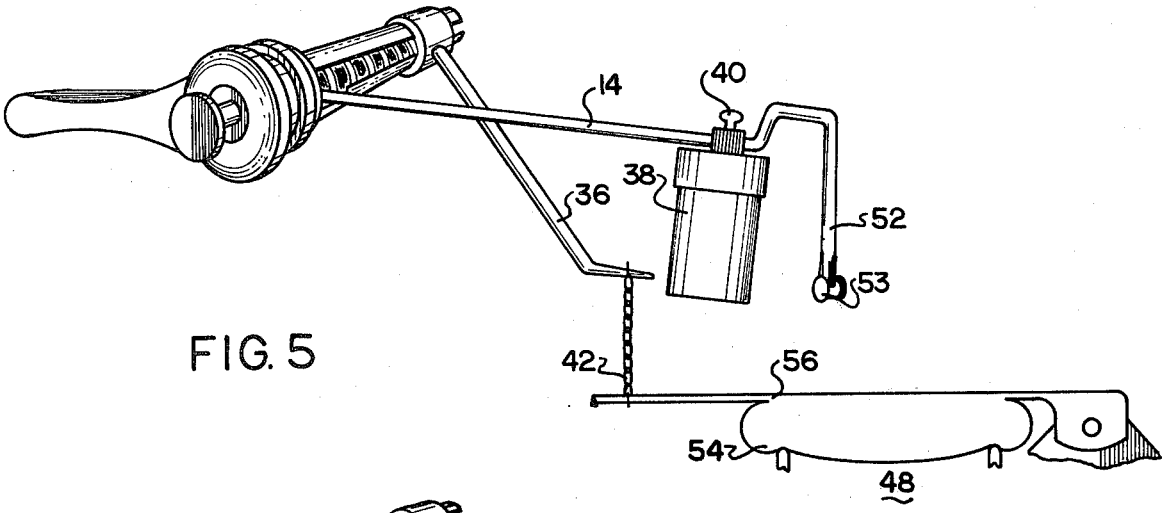
FIG. 5 is another embodiment of the invention as it is installed.

Turning now to FIG. 5, it is seen that another embodiment of the instant invention is illustrated. In this application, an end section 52 of the half-flush rod 14 contains, at its very tip, a roller 53. As the water level in the tank falls, the roller 53 presses down upon a stopper connection rod 56 which closes a hinged flush stopper 54. In all other respects, the operation of the embodiment shown in FIG. 5 is similar to that previously described.

Figure 6:
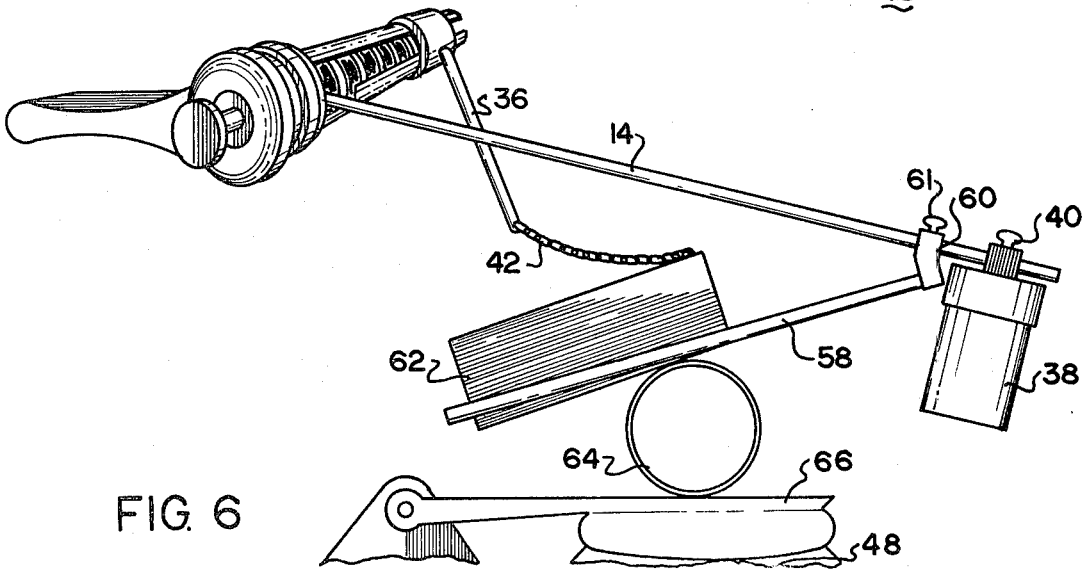
FIG. 6 is yet another embodiment of the invention as it is installed.

Yet another illustration of the invention is shown in FIG. 6, in which the end section 58 of the half-flush rod 14 is shown as an extension connected to the half-flush rod 14 by means of a connection piece 60. The end section 58 is adjustable by means of a set screw 61 along the length of the half-flush rod 14. In operation, the flush lever 36 lifts a pair of tubes 62 and 64 by means of the chain 42 which thereby allows a hinge flush stopper 66 to rise and allow water to drain out through the tank drain 48. In similar fashion as described hereinabove, drainage of water from the tank allows the half-flush rod 14 and the end piece 58 to progressively rotate downward, until the end piece 58 touches the tubes 62 and 64 which thereafter close the hinged flush stopper 66 to preclude further draining. Again, as above, the float 38 is adjustable along the length of the half-flush rod 14 by means of set screw 40 and its buoyancy can be varied so that various individual commodes can be accomodated.

Two significant advantages of the instant invention over the prior art are that (1) use of this invention allows retention of the vast majority of the conventional parts found in a variety of commodes, and (2) the half-flush mechanism always remains in the full flush mode until the button 12 is pushed. Thus, those persons using the commode who are unfamiliar with the operation of the half-flush mechanism can operate the flush in a conventional manner. Further, the invention is applicable not only to the particular commode designs illustrated in this description, but may be applied to nearly all designs utilizing a tank and a gravity flush merely by installing the appropriate end piece to the half-flush rod.

The materials of construction of the half-flush mechanism 10 may be any one of the conventional materials known in the art which provide the corrosion resistance necessary for constant contact with the water in the tank. By way of example, the parts of the half-flush mechanism 10 described herein may be constructed of such metals as brass, copper, stainless steel, aluminum and the like or may be constructed of any one of the plastic materials currently being utilized in the construction of conventional flushing mechanisms. Such plastics include polyvinyl chloride, acrylonitrile-butadiene-styrene copolymers, various polyethylenes and polypropylenes, nylons, and copolymers of any or all of the above. In addition, it is appreciated that the half-flush mechansim 10 may be constructed of combinations of any of the above metals and plastics.

Thus it can be seen that the objects of the invention have been satisfied by the structure presented hereinabove. The concept of the invention is applicable to a variety of commodes flushing mechanism designs and modifies existing mechanisms so as to retain as many conventional parts as possible. Thereby, the cost of conversion to a half-flush mechanism is reduced. While in accordance with the Patent Statutes, only the best mode and preferred embodiment of the invention has been presented and described in detail, it is to be understood that the invention is not limited thereto or thereby. Accordingly, for an appreciation of the true scope and breadth of the invention, reference should be had to the appended claims.

What is claimed is:

1. A half-flush mechanism for a commode, comprising:

an angled half-flush rod having first and second legs extending from an apex;

a float attached to said first leg of said angled rod which leg is located within the commode tank;

a flush handle external of said tank, through which is slidably mounted said second leg of said angled rod;

a push button located at the end of said second leg;

a compression spring applying a force to said angled rod at its apex;

a mechanism housing surrounding said spring and at least a portion of said second leg of said angled rod;

a stationary mount which prevents operation of said half-flush mechanism during operation of said flush handle;

a housing end piece which fits over said mechanism housing;

a flush lever attached to said housing end piece; and means for securing said mechanism to the commode tank wall.

2. A half-flush mechanism according to claim 1, wherein said mechanism housing contains a slit for the slidable accomodation of said first leg of said angled rod.

3. A half-flush mechanism according to claim 2, wherein said mechanism housing contains a cut-out for rotational accomodation of said first leg of said angled rod.

4. A half-flush mechanism according to claim 3, wherein said stationary mount supports said first leg of said angled rod and thereby prevents activation of said half-flush mechanism when a full flush is desired.

5. A half-flush mechanism according to claim 4, wherein said compression spring exerts a bias on said apex of said angled rod which maintains said first leg on said stationary mount until a force is exerted on said push button to overcome said spring bias and force said first leg off said stationary mount thereby activating said half-flush mechanism.

6. A half-flush mechanism according to claim 5, wherein said first leg of said angled rod contains an end piece which effects closure of the drain plug in the commode tank after less than the full complement of water in the tank has been drained.

7. A half-flush mechanism according to claim 6, wherein the amount of water which drains from the commode tank before the drain plug is closed by said first leg end piece is user controlled by altering the buoyancy of said float with ballast and by changing the location of said float along said first leg of said angled rod.

8. A half-flush mechanism according to claim 7, wherein said flush lever activates the flushing cycle by rotation in unison with the axial rotation of said mechanism housing in said flush lever.

9. A half-flush mechanism according to claim 8, wherein to the tip of said second leg of said angled rod is attached said push button, the pushing of which causes axial travel of said second rod in the direction of the commode tank wall.

10. A half-flush mechanism according to claim 9, wherein the materials of construction of said half-flush mechanism are selected from the group consisting of aluminum, copper, brass, stainless steel, copolymers of acrylo-nitrile-butadiene-styrene, polyvinyl chloride, polyethylenes, polypropylenes, nylons, and copolymers and combinations of the foregoing polymers and metals.

11. A half-flush mechanism according to claim 10, wherein said half-flush mechanism is secured to the commode tank wall by means of a tank wall insert and a threaded nut.

* * * * *